United States Patent [19]

Claringbull

[11] 4,401,168

[45] Aug. 30, 1983

[54] IMPACT APPLYING MECHANISM

[75] Inventor: Peter Claringbull, Kuala Lumpur, Malaysia

[73] Assignee: Conzinc Riotinto Malaysia Sendirian Berhard, Malaysia

[21] Appl. No.: 281,690

[22] Filed: Jul. 9, 1981

[51] Int. Cl.[3] ..... E21B 1/02

[52] U.S. Cl. ..... 173/135; 173/57; 173/115; 91/50; 91/325

[58] Field of Search ..... 173/57, 74, 78, 79, 173/119, 120, 121, 114, 115, 134, 135, 137; 91/50, 321, 325; 166/77

[56] References Cited

U.S. PATENT DOCUMENTS

| | | | |
|---|---|---|---|
| 2,041,690 | 5/1936 | Baumeister et al. | 173/78 X |
| 2,169,675 | 8/1939 | Bays | 173/57 X |
| 2,258,001 | 10/1941 | Chamberlain | 173/57 X |
| 2,786,451 | 3/1957 | Dulaney | 91/50 X |
| 2,813,516 | 11/1957 | Dulaney | 91/50 X |
| 3,259,196 | 7/1966 | Hawthorne | 173/78 |
| 3,691,907 | 9/1972 | Paschke | 91/321 |

*Primary Examiner*—Robert C. Watson
*Assistant Examiner*—Robert P. Olszewski
*Attorney, Agent, or Firm*—Bernard, Rothwell & Brown

[57] ABSTRACT

There is disclosed an impact applying mechanism, particularly as applied in a subterranean drilling apparatus, and comprising a cylinder (13) arranged with its axis substantially vertical and connected to the member to which impact is to be applied, a piston (5) slidably mounted within the cylinder (13), means to admit pressure fluid to the cylinder (13) below the piston (5), at least one valve tube (24), slidably mounted in the base of the cylinder (13), coil springs (30) to bias the upper end of the valve tubes (24) into sealing engagement with the underside of the piston (5) when the piston is in its lowest position, a flange (26) on the upper end of the valve tubes (24) upon which fluid pressure in the cylinder (13) acts to produce a force urging the end of the valve tubes (24) into contact with the underside of the piston (5), and further coil springs (32) to provide a force to said valve tubes (24) of a magnitude which increases as the piston (5) moves upwardly relative to the cylinder (13) to subsequently urge the ends of the valve tubes (24) out of contact with the underside of the piston (5). Nuts (28) are also provided to enable the force exerted by the further coil springs (32) to be adjusted to vary the stroke of the piston (5) by varying the point at which the seal between the valve tubes (24) and the underside of the piston (5) is broken and the pressure is released from the cylinder (13) through the valve tubes (24

12 Claims, 4 Drawing Figures

IMPACT APPLYING MECHANISM

TECHNICAL FIELD

This invention relates to an improved apparatus for applying periodic impulses to a mechanism and while it is not restricted thereto it is particularly suitable for use in connection with the drilling and mining apparatus disclosed and claimed in my co-pending Australian Patent Application No. 56241/80 corresponding to U.S. Pat. No. 4,319,784.

BACKGROUND ART

In the specification of Application Ser. No. 56241/80, there is disclosed a method and means for mining underground alluvial deposits by firstly drilling a hole from surface level down to the deposit and then excavating the deposit by means of water jets. The apparatus disclosed in the specification includes means for applying periodic impacts to the casing during the operation of drilling the hole from the surface down to the level at which excavation is to be carried out.

It is an object of the present invention to provide an improvement on the impact applying mechanism disclosed in our prior application. As indicated above however, the mechanism can be applied to any situation where periodic impulses are required.

DISCLOSURE OF THE INVENTION

According to its broadest aspect the invention provides an impact applying mechanism comprising a cylinder arranged with its axis substantially vertical and connected, in use, to the member to which impact is to be applied, a piston slidably mounted within said cylinder, means to admit pressure fluid to said cylinder below said piston, at least one passage means slidably mounted in the base of the cylinder, first means to bias the upper end of the passage means into sealing engagement with the underside of the piston when the piston is in its lowest position, a projecting portion on the upper end of the passage means upon which fluid pressure in the cylinder acts to produce a force urging the end of the passage means into contact with the underside of the piston, and further biasing means to provide a force to said passage means of a magnitude which increases as the piston moves upwardly relative to the cylinder to subsequently urge the end of the passage means out of contact with the underside of the piston.

Means may be provided to enable the force exerted by said further biasing means to be adjusted to vary the stroke of the piston by varying the point at which the seal between the passage means and the underside of the piston is broken and the pressure is released from the cylinder through said passage means.

According to another aspect of the invention there is provided means for subterranean drilling comprising a casing having a drilling shoe mounted at its lower end, an inner pipe mounted within the casing and capable of sliding longitudinally relative to the casing, a cylinder mounted concentrically on the casing at the upper end of the casing, a piston slidably mounted within the cylinder, the piston being fixedly connected to the inner pipe, means to admit pressure fluid to said cylinder below said piston, at least one passage means slidably mounted in the base of the cylinder, first means to bias the upper end of the passage means into sealing engagement with the underside of the piston when the piston is in its lowest position, a projecting portion on the upper end of the passage means capable of being acted upon which fluid pressure in the cylinder acts to produce a force urging the end of the passage means into contact with the underside of the piston, and further biasing means to provide a force to said passage means of a magnitude which increases as the piston moves upwardly relative to the cylinder to subsequently urge the end of the passage means out of contact with the underside of the piston.

With such an arrangement the inner pipe forms part of the impact weight and as a result impact force increases with depth of hole, and thus penetration rate is not adversely affected by greater hole depth.

BRIEF DESCRIPTION OF THE DRAWINGS

In order that the invention may be more readily understood it will now be described with reference to the accompanying drawings wherein.

Figure 1:
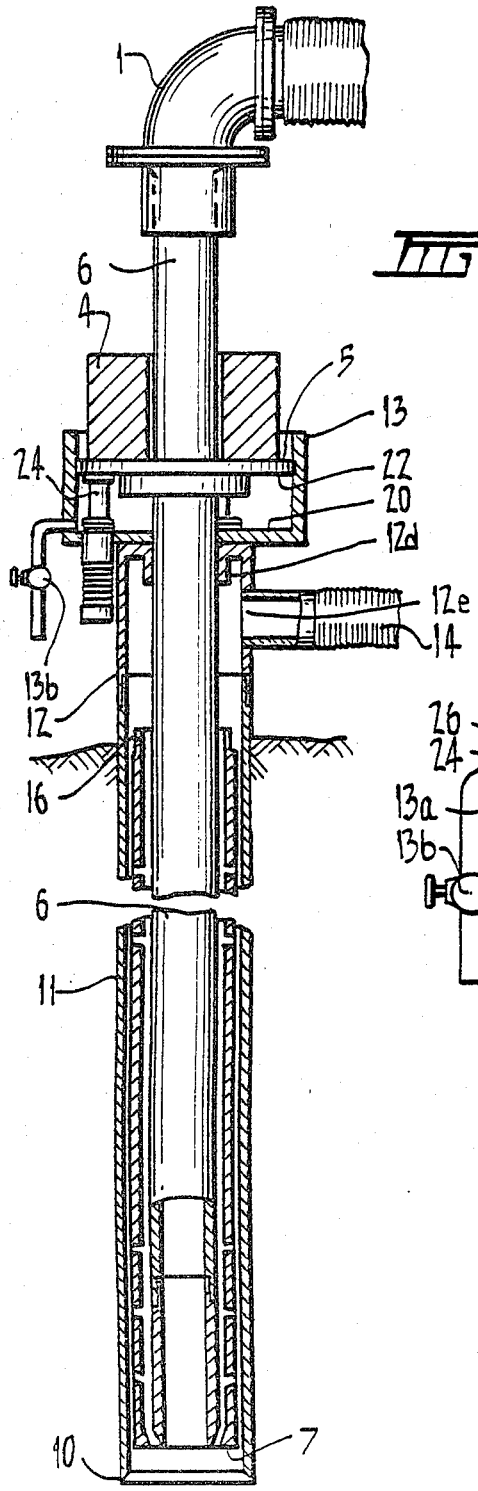
FIG. 1 is a cross-sectional elevational view of apparatus according to the invention.

Where possible reference numerals have been kept the same as in our prior application Ser. No. 56241/80.

BEST MODE FOR CARRYING OUT THE INVENTION

The apparatus has an inner pipe 6 at the upper end of which there is a swivel connection, by means of which a pipe bend 1 is rotatably connected to the inner pipe 6. Pipe bend 1 has an internal diameter which is greater than that of the inner pipe 6 to allow the passage of large pieces of material without blocking the bend. Th other end of pipe bend 1 has connected to it a flexible discharge pipe by means of which material removed by the apparatus is conveyed to a collection point for sampling and re-circulation of the water.

The lower end of inner pipe 6 has attached to it a drilling jet cutting shoe 7 which may be of any suitable form. An intermediate pipe 16 is arranged concentrically around inner pipe 6 and is also connected to cutting shoe 7. Both the inner pipe 6 and the intermediate pipe 16 may be made up of a variable number of pipe lengths depending on the requirements of the drilling/-mining operation.

The pipe lengths are connected by flush integral screw connections or other suitable means.

The intermediate pipe is surrounded by a casing 11 in which intermediate pipe 16 and cutting shoe 7 are fitted with sufficient clearance to enable intermediate pipe 16 to slide relative to the casing 11. The lower end of casing 11 is provided with a casing cutting shoe 10. This cutting shoe may be of any suitable configuration for example, serrated, toothed or plain round depending on the nature of the ground to be drilled. The lower edge is hardened and sharpened to provide good wear and cutting characteristics.

The upper end of casing 11 is connected to a pressure head 12 and a seal is formed between the inner pipe 6 and the pressure head as indicated at 12*d*. The pressure head 12 is provided with an inlet 12*e* to which is connected a flexible water pipe 14 for the supply of water under pressure from a conventional pumping facility.

Above pressure head 12 there is arranged an impact cylinder 13 in which an impact piston 5 is mounted for vertical movement. A detachable drilling weight 4 is supported by impact piston 5.

Impact piston 5 is connected by welding or any other suitable means to inner pipe 6 and impact cylinder 13 is connected by appropriate means to casing 11. Impact cylinder 13 is fitted with an inlet 13*a* controlled by regulating valve 13*b* to admit water and/or air into the cylinder from conventional supply sources.

As indicated in the specification of our earlier Application Ser. No. 56241/80, the rate at which drilling can be carried out can be significantly increased by applying periodic impacts to the casing 11. These impacts are applied with the present apparatus in the following manner.

Figure 2:
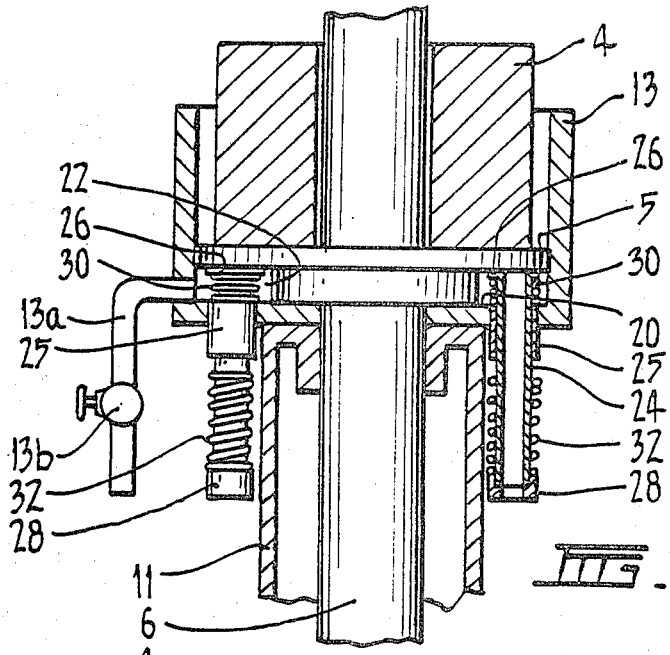
FIG. 2 is an enlarged view of part of FIG. 1 showing the impact piston at the commencement of its upstroke.

Initially the piston 5 is in its lowest position as illustrated in FIG. 2 resting on the base 20 of impact cylinder 13. The outer part of piston 5 is relieved as shown at 22 to accommodate one or more valve tubes 24 which project upwardly through the base of impact cylinder 13 through guides 25 in which they are a sliding fit. Each of the valve tubes 24 is hollow and is capable of providing a direct connection between the interior of the impact cylinder 13 and the atmosphere.

The upper end of each valve tube 24 is provided with a rubber sealed flange 26 and the lower end of each valve tube is provided with an adjusting nut 28.

A spring or elastic sleeve 30 located between the underside of each flange 26 and the base of the impact cylinder 13 provides an upward bias for each valve tube 24.

A further spring or elastic sleeve 32 is located between each valve tube guide and the adjusting nut on each valve tube 24 to provide a downward bias for each valve tube.

In the position shown in FIG. 2, the spring 30 is compressed and provides a sealing engagement between the upper end of each flange 26 and the underside of piston 5. Pressure fluid admitted to cylinder 13 through valve 13*b* cannot escape from the cylinder through valve tubes 24 and therefore raises impact piston 5 and with it the inner pipe 6.

Pressure against the underside of flanges 26 assists in retaining valve tubes 24 in sealing engagement with the underside of piston 5.

Figure 3:
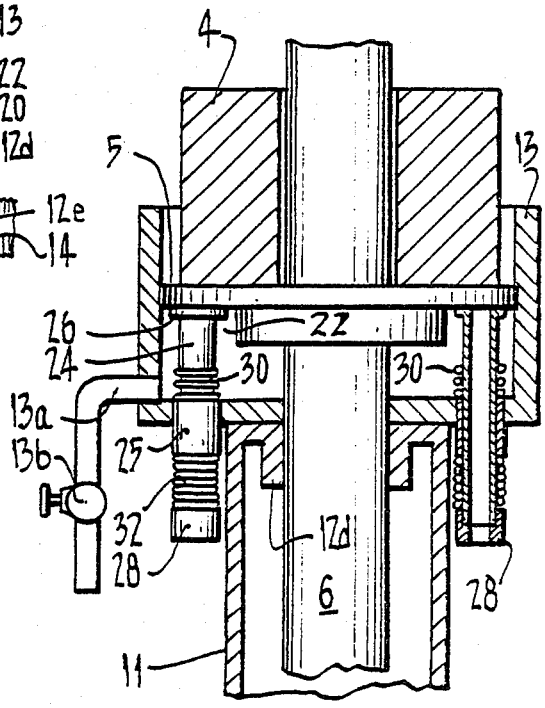
FIG. 3 is a view similar to FIG. 2 showing the piston during its upstroke.

FIG. 3 shows the situation in which the piston has been raised to such an extent that the compression in springs 30 has been entirely released and springs 32 have been compressed by the upward motion of valve tubes 24. Nevertheless at this stage the pressure on the underside of flanges 26 maintains the upper ends of the valve tubes in sealing engagement with the underside of piston 5.

Figure 4:
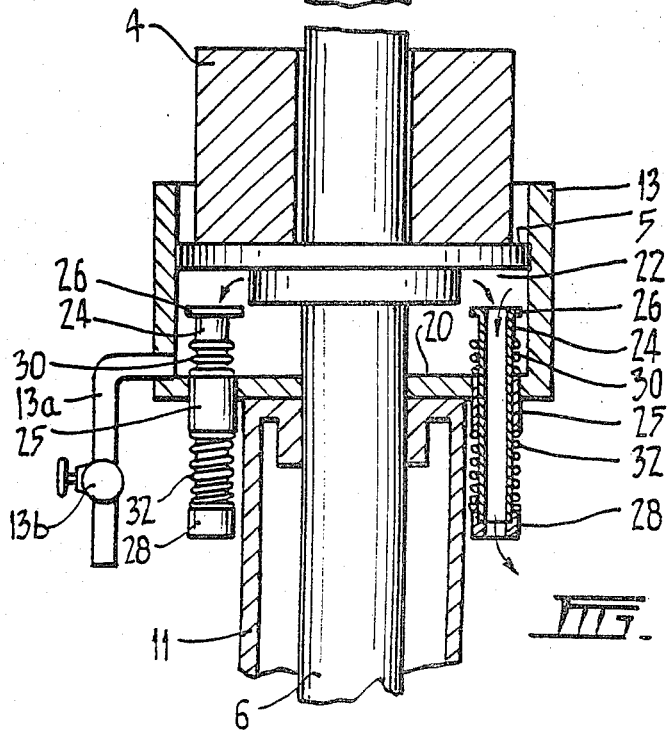
FIG. 4 is a view similar to FIG. 2 showing the piston during its downstroke.

When the stage is reached at which the downward force applied to the valve tubes by the springs 32 exceeds the upward force applied to flanges 26 by the pressure within the cylinder, the seal between the valve tubes 24 and the underside of the piston is broken and the valve tubes move rapidly downward to provide communication between the interior of cylinder 13 and the atmosphere as shown in FIG. 4.

The pressure fluid is rapidly discharged and the piston, to which the weight of the inner pipe 6 and the weight 4 are applied, drops until the underside of the piston strikes against the base of cylinder 13. The impact is transmitted downwardly through the casing 11 to the cutting shoe at the lower end of the casing and drives the casing into the material being drilled. This returns the mechanism to the stage illustrated in FIG. 2 and the next cycle then commences.

The stroke of the piston can be adjusted by means of the nuts 28 on the valve tubes 24. Screwing nuts 28 in a direction to reduce the space available for lower springs 32 shortens the stroke while movement of the nuts in the opposite direction lengthens the stroke and therefore increases the magnitude of each impact.

The frequency of the impact depends in part upon the setting of the adjusting nuts 28 but is mainly controlled by the extent to which valve 13*b* is open and the fluid pressure which is applied to the system.

The invention provides a very satisfactory impact applying mechanism which is readily controlled to give optimum magnitude and frequency of impacts. The mechanism is simple with few moving parts and therefore requires little or no maintenance.

I claim:

1. An impact applying mechanism comprising a cylinder arranged with its axis substantially vertical and connected, in use, to a member to which impact is to be applied, a piston slidably mounted within said cylinder, means to admit pressure fluid to said cylinder below said piston, at least one passage means slidably mounted in the base of the cylinder, first means to bias the upper end of the passage means into sealing engagement with the underside of the piston when the piston is in its lowest position, a projecting portion on the upper end of said passage means upon which fluid pressure in the cylinder acts to produce a force urging the end of said passage means into contact with the underside of the piston, and further biasing means to provide a force to said passage means of a magnitude which increases as the piston moves upwardly relative to the cylinder to subsequently urge the end of the passage means out of contact with the underside of the piston.

2. An impact applying mechanism as claimed in claim 1, wherein means are provided to enable the force exerted by said further biasing means to be adjusted to vary the stroke of the piston by varying the point at which the seal between the passage means and the underside of the piston is broken and the pressure is released from the cylinder through said passage means.

3. An impact applying mechanism as claimed in claim 1 or 2, wherein said passage means is a valve tube and said first and further biasing means are spring means.

4. An impact applying mechanism as claimed in claim 3, wherein said first spring means is a coil spring received around said valve tube and compressed between the base of the cylinder and said projecting portion when the piston is in said lowest position, and said further spring means is a coil spring received around said valve tube and which is progressively compressed as said piston and said valve tube move upwardly relative to the cylinder.

5. An impact applying mechanism as claimed in claim 4, wherein said further coil spring is progressively compressed between means carried by the end of the valve tube below said cylinder and a sleeve in said base of the cylinder for guiding said valve tube.

6. An impact applying mechanism as claimed in claim 2, wherein said passage means is a valve tube and said first and further biasing means are spring means, and wherein said first spring means is a coil spring received around said valve tube and said projecting portion when the piston is in said lowest position, and said further spring means is a coil spring received around said valve tube and which is progressively compressed as said piston and valve tube move upwardly relative to the cylinder, and wherein said further coil spring is progressively compressed between a nut carried by the end of the valve tube below said cylinder and a sleeve in said base of the cylinder for guiding said valve tube, which nut is adapted to traverse along said valve tube to provide said adjustment means.

7. A subterranean drilling apparatus comprising a casing having a drilling shoe mounted at its lower end, an inner pipe mounted within the casing and capable of sliding longitudinally relative to the casing, a cylinder mounted concentrically on the casing at the upper end thereof, a piston slidably mounted within the cylinder, the piston being fixedly connected to the inner pipe, means to admit pressure fluid to said cylinder below said piston, at least one passage means slidably mounted in the base of the cylinder, first means to bias the upper end of the passage means into sealing engagement with the underside of the piston when the piston is in its lowest position, a projecting portion on the upper end of the passage means upon which fluid pressure in the cylinder acts to produce a force urging the end of the passage means into contact with the underside of the piston, and further biasing means to provide a force to said passage means of a magnitude which increases as the piston moves upwardly relative to the cylinder to subsequently urge the end of the passage means out of contact with the underside of the piston.

8. A subterranean drilling apparatus as claimed in claim 7, wherein means are provided to enable the force exerted by said further biasing means to be adjusted to vary the stroke of the piston by varying the point at which the seal between the passage means and the underside of the piston is broken and the pressure is released from the cylinder through said passage means.

9. A subterranean drilling apparatus as claimed in claim 7 or 8, wherein said passage means is a valve tube and said first and further biasing means are spring means.

10. A subterranean drilling apparatus as claimed in claim 9, wherein said first spring means is a coil spring and said coil spring is received around said valve tube and compressed between the base of the cylinder and said projecting portion when the piston is in said lowest position, and said further spring means is a coil spring and said coil spring is received around said valve tube and is progressively compressed as the piston and said valve tube move upwardly relative to the cylinder.

11. A subterranean drilling apparatus as claimed in claim 10, wherein said further coil spring is progressively compressed between means carried by the end of the valve tube below said cylinder and a sleeve in said base of the cylinder for guiding said valve tube.

12. A subterranean drilling apparatus as claimed in claim 8, wherein said passage means is a valve tube and said first and further biasing means are spring means, and wherein said first spring means is a coil spring and said coil spring is received around said valve tube and compressed between the base of the cylinder and said projecting portion when the piston is in said lowest position, and said further spring means is a coil spring and said coil spring is received around said valve tube and is progressively compressed as the piston and said valve tube move upwardly relative to the cylinder, and wherein said further coil spring is progressively compressed between a nut carried by the end of the valve tube below said cylinder and a sleeve in said base of the cylinder for guiding said valve tube, which nut is adapted to traverse along said valve tube to provide said adjustment means.

* * * * *